US011578548B2

(12) United States Patent
Webber et al.

(10) Patent No.: US 11,578,548 B2
(45) Date of Patent: Feb. 14, 2023

(54) CONVERTIBLE FLOAT VALVE ASSEMBLIES AND METHODS OF USING CONVERTIBLE FLOAT VALVE ASSEMBLIES

(71) Applicant: FORUM US, INC., Houston, TX (US)

(72) Inventors: Andrew Webber, Hockley, TX (US); Jeffry C. Ehlinger, Houston, TX (US)

(73) Assignee: Forum US, Inc., Houston, TX (US)

( * ) Notice: Subject to any disclaimer, the term of this patent is extended or adjusted under 35 U.S.C. 154(b) by 216 days.

(21) Appl. No.: 17/017,373

(22) Filed: Sep. 10, 2020

(65) Prior Publication Data

US 2022/0074276 A1 Mar. 10, 2022

(51) Int. Cl.
*E21B 21/10* (2006.01)

(52) U.S. Cl.
CPC ..... *E21B 21/10* (2013.01); *E21B 2200/04* (2020.05); *E21B 2200/05* (2020.05)

(58) Field of Classification Search
CPC ... E21B 21/10; E21B 2200/04; E21B 2200/05
See application file for complete search history.

(56) References Cited

U.S. PATENT DOCUMENTS 4,729,432 A * 3/1988 Helms ..... E21B 34/14 166/317
6,401,824 B1 * 6/2002 Musselwhite ..... E21B 34/14 166/334.4
6,679,336 B2 1/2004 Musselwhite et al.
7,168,494 B2 1/2007 Starr et al.
8,397,823 B2 * 3/2013 Xu ..... E21B 23/00 166/373
8,955,543 B2 2/2015 Groesbeck et al.
8,991,505 B2 * 3/2015 Fleckenstein ..... E21B 43/26 166/334.4
2002/0148615 A1 10/2002 Szarka et al.
2011/0290344 A1 * 12/2011 Groesbeck ..... E21B 21/10 137/430
2014/0202708 A1 7/2014 Jacob et al.
2016/0251923 A1 * 9/2016 Keerthivasan ..... E21B 34/14 166/383

OTHER PUBLICATIONS

PCT International Search Report and Written Opinion dated Feb. 24, 2022, for International Application No. PCT/US2021/049419.
PCT Invitation to Pay Additional Fees dated Jan. 3, 2022, for International Application No. PCT/US2021/049419.

* cited by examiner

*Primary Examiner* — Christopher J Sebesta
(74) *Attorney, Agent, or Firm* — Patterson + Sheridan, LLP

(57) ABSTRACT

Aspects of the disclosure relate to convertible float valve assemblies, and associated components thereof, and methods of using convertible float valve assemblies. A convertible float valve assembly may comprise a sleeve, one or more valves and valve bodies coupled to the sleeve, and a collet coupled to the sleeve. A method may comprise lowering the convertible float valve assembly and a ball downhole, seating the ball on the collet, and releasing the sleeve from the one or more valve bodies.

19 Claims, 10 Drawing Sheets

CONVERTIBLE FLOAT VALVE ASSEMBLIES AND METHODS OF USING CONVERTIBLE FLOAT VALVE ASSEMBLIES

BACKGROUND

Field

Aspects of the disclosure relate to convertible float valve assemblies, and associated components thereof, and methods of using convertible float valve assemblies.

Description of the Related Art

Issues can arise when attempting to activate float valves. For example, clogging (such as by fluids or debris) can interfere with dropping a ball from surface to a float valve. Clogging can also cause a float valve to inadvertently activate prior to when it is desired for an operator to do so. It can also take a substantial amount of time and a substantial amount of fluid circulation to activate float valves.

Therefore, there is a need for convertible float valve assemblies and methods that reliably and accurately activate the convertible float valve assemblies at reduced timespans and reduced fluid circulation without dropping a ball from surface.

SUMMARY

Aspects of the disclosure relate to convertible float valve assemblies, and associated components thereof, and methods of using convertible float valve assemblies. In one example, a convertible float valve assembly is lowered downhole with a ball that is free-floating.

In one implementation, a convertible float valve assembly comprises a sleeve comprising a first end and a second end; one or more valve bodies disposed about the sleeve; one or more valves disposed about the sleeve and coupled to the one or more valve bodies; and a collet coupled to the sleeve and disposed at least partially within the sleeve, the collet comprising a ring body, a plurality of collet fingers extending from the ring body, and a plurality of slots formed between the plurality of collet fingers.

In one implementation, a convertible float valve assembly comprises a sleeve comprising a first end and a second end; one or more valve bodies disposed about the sleeve; one or more valves disposed about the sleeve and coupled to the one or more valve bodies; and a collet coupled to the sleeve and disposed at least partially within the sleeve, wherein the collet is formed of a dissolvable material.

In one implementation, a method of operating a convertible float valve assembly comprises lowering the convertible float valve assembly and a ball downhole, the convertible float valve assembly comprising a collet and one or more valves in an open position; pumping a fluid downhole at an operating pressure; seating the ball on a collet seat of the collet to induce a first pressure indication that indicates a first pressure greater than the operating pressure; and releasing a sleeve of the convertible float valve assembly from one or more valve bodies of the convertible float valve assembly.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
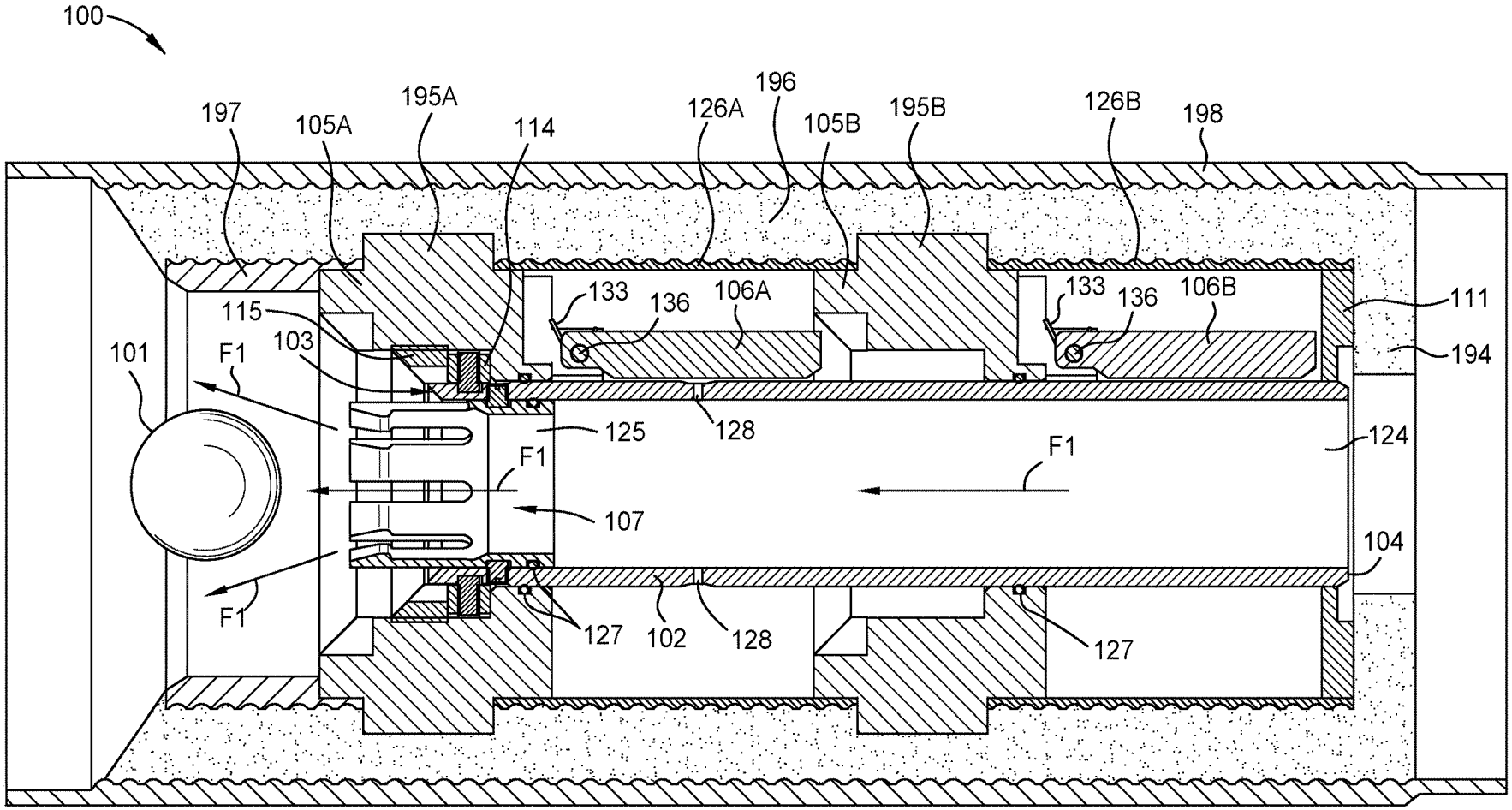
FIG. 1A is a schematic cross-sectional view of a convertible float valve assembly and a ball, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the disclosure relate to convertible float valve assemblies, and associated components thereof, and methods of using convertible float valve assemblies. In one example, a convertible float valve assembly is lowered downhole with a ball that is free-floating.

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling.

Figure 1B:
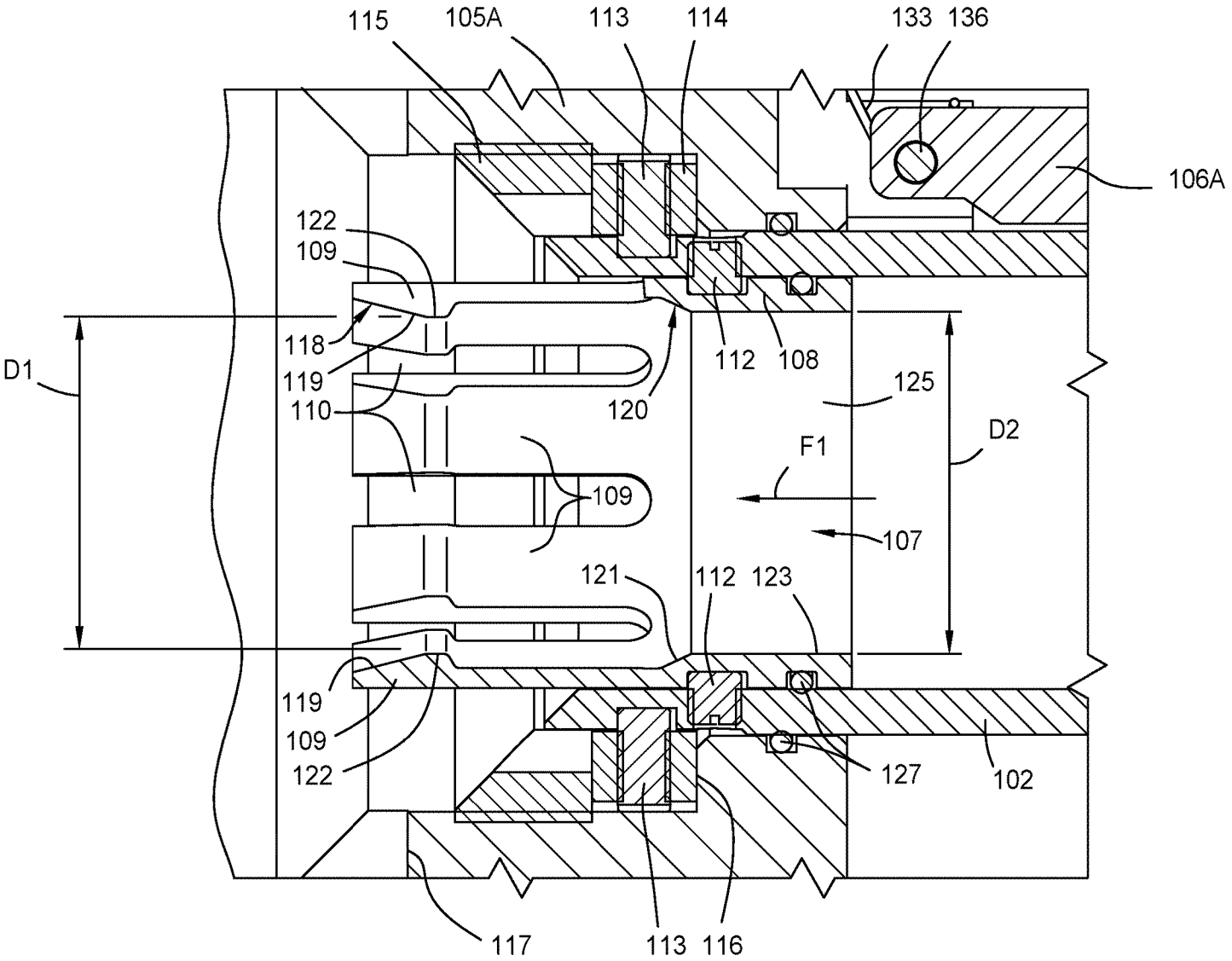
FIG. 1B is an enlarged view of a portion of the convertible float valve assembly shown in FIG. 1A, according to one implementation.

FIG. 1A is a schematic cross-sectional view of a convertible float valve assembly 100 and a ball 101, according to one implementation. FIG. 1B is an enlarged view of a portion of the convertible float valve assembly 100 shown in FIG. 1A, according to one implementation. The convertible float valve assembly 100 and the ball 101 are shown in FIG. 1A when lowered downhole into a wellbore. The convertible float valve assembly 100 includes a sleeve 102 having a first end 103 and a second end 104, one or more valve bodies 105A, 105B (two are shown) disposed about the sleeve 102, and one or more valves 106A, 106B (two are shown) disposed about the sleeve and coupled to the one or more valve bodies 105A, 105B. The valves 106A, 106B are flapper valves. The valves 106A, 106B are held in an open position (shown in FIG. 1A) using the sleeve 102. The convertible float valve assembly 100 includes a ring cover 111 disposed adjacent the second end 104 of the sleeve 102. The ring cover 111 protects the valves 106A, 106B from debris and fluids, when lowered downhole into a wellbore. The convertible float valve assembly 100 is shown in an autofill mode in FIG. 1A such that the fluid F1 flows into and through the convertible float valve assembly 100.

The convertible float valve assembly 100 includes a collet 107 coupled to the sleeve 102 adjacent the first end 103. The collet 107 is disposed at least partially within the sleeve 102. The collet 107 includes a ring body 108, a plurality of collet fingers 109 extending from the ring body 108, a plurality of slots 110 formed between the collet fingers 109. The collet 107 includes eight collet fingers 109 (shown in FIG. 5) and eight slots 110 (shown in FIG. 5) between the collet fingers 109. The collet 107 is coupled to the sleeve 102 using fasteners 112, such as screws, bolts, and/or pins. The collet 107 includes a collet seat 118. The collet seat 118 is defined at least partially by a plurality of angled inner surfaces 119 of the collet fingers 109. The angled inner surfaces 119 may be tapered or curved, such as rounded. The collet 107 includes a sealing seat 120 formed inwardly of the collet seat 118 and the slots 110. The sealing seat 120 includes one or more angled inner surfaces 121 (one is shown). The angled inner surfaces 121 may be tapered or curved, such as rounded.

The convertible float valve assembly 100 includes tubular sections 126A, 126B (two are shown). A first tubular section 126A is disposed between and coupled between the outer shoulders 195A, 195B of the valve bodies 105A, 105B. A second tubular section 126B is disposed between and coupled between the outer shoulder 195B of the second valve body 105B and a shoulder 194 of cement 196. The tubular sections 126A, 126B are disposed about the valves 106A, 106B. The tubular sections 126A, 126B are coupled to one or more components of the convertible float valve assembly 100, such as the first valve body 105A, the second valve body 105B, and/or the ring cover 111. The ring cover 111 is coupled to the second tubular section 126B.

The convertible float valve assembly 100 also includes seals 127, such as O-ring seals. The convertible float valve assembly 100 includes a seal 127 between an outer surface of the ring body 108 and an inner surface of the sleeve 102, a seal 127 between an outer surface of the sleeve 102 and an inner surface of the first valve body 105A, and a seal 127 between the outer surface of the sleeve 102 and an inner surface of the second valve body 105B. The sleeve 102 includes a plurality of pressure relief ports 128 formed in a wall of the sleeve 102. A retention sleeve 197 is coupled to the first valve body 105A. A float collar 198 is disposed about the retention sleeve 197, the tubular sections 126A, 126B, and the valve bodies 105A, 105B. The cement 196 is formed about the retention sleeve 197, the tubular sections 126A, 126B, the valve bodies 105A, 1056, and the ring cover 111. The cement 196 is formed on an inner side of the float collar 198. The float collar 198 is formed of a composite material. The retention sleeve 197, the tubular sections 126A, 126B, the valve bodies 105A, 105B, and the ring cover 111 are encapsulated within the cement 196. The cement 196 is encased within the float collar 198. The float collar 198 is an example of a pressure retaining tubular that is disposed about the cement 196.

The collet seat 118 includes a first seat diameter D1. In one embodiment, which can be combined with other embodiments, the first seat diameter D1 is taken at inward ends of the respective angled inner surfaces 119. In one embodiment, which can be combined with other embodiments, the first seat diameter D1 corresponds to first inner faces 122 of the collet fingers 109. The sealing seat 120 includes a second seat diameter D2. In one embodiment, which can be combined with other embodiments, the second seat diameter D2 is taken at an inward end of the respective one or more angled inner surfaces 121. In one embodiment, which can be combined with other embodiments, the second seat diameter D2 corresponds to one or more second inner faces 123 of the ring body 108. The convertible float valve assembly 100 also includes one or more shearable fasteners 113 coupled to the sleeve 102 and disposed between the sleeve 102 and the first valve body 105A. The shearable fasteners 113 may include, for example, shear pins and/or shear screws.

The shearable fasteners 113 are housed in a fastener housing 114. The fastener housing 114 is a ring. The fastener housing 114 is retained within the first valve body 105A using a retainer ring 115 coupled to the first valve body 105A. In one example, the retainer ring 115 is threaded to the first valve body 105A. In one embodiment, which can be combined with other embodiments, the fastener housing 114 is a free-floating ring that is retained between the retainer ring 115 and the first valve body 105A. The fastener housing 114 is retained between the retainer ring 115 and a first inner shoulder 116 of the first valve body 105A. The first valve body 105A also includes a second inner shoulder 117 that is recessed outwardly of the first inner shoulder 116.

In one embodiment, which can be combined with other embodiments, the one or more shearable fasteners 113 are formed of a dissolvable material that dissolves upon interaction with an abrasive material, a chemical dissolution material, and/or an erosion material such that the shearable fasteners 113 shear. The dissolvable material of the one or more shearable fasteners 113 may be the same material as the dissolvable material (described below) of the collet 107. The dissolvable material of the shearable fasteners 113 can allow the remainder of shearable fasteners 113 coupled to the fastener housing 114—after shearing of the shearable fasteners 113—to dissolve over time.

When lowered downhole into a wellbore, the valves 106A, 106B are in the open position, and a fluid F1 flows through a central opening 124 of the sleeve 102, through a central opening 125 of the collet 107, and past the ball 101. When lowered downhole (as shown in at least FIG. 1A), the ball 101 is free-floating above the collet 107. The ball 101 is free-floating such that it may move to be at a gap from the collet 107. In one embodiment, which can be combined with other embodiments, the fluid F1 is an operation fluid (such as drilling fluid or casing cement) that is pumped downhole.

Figure 2A:
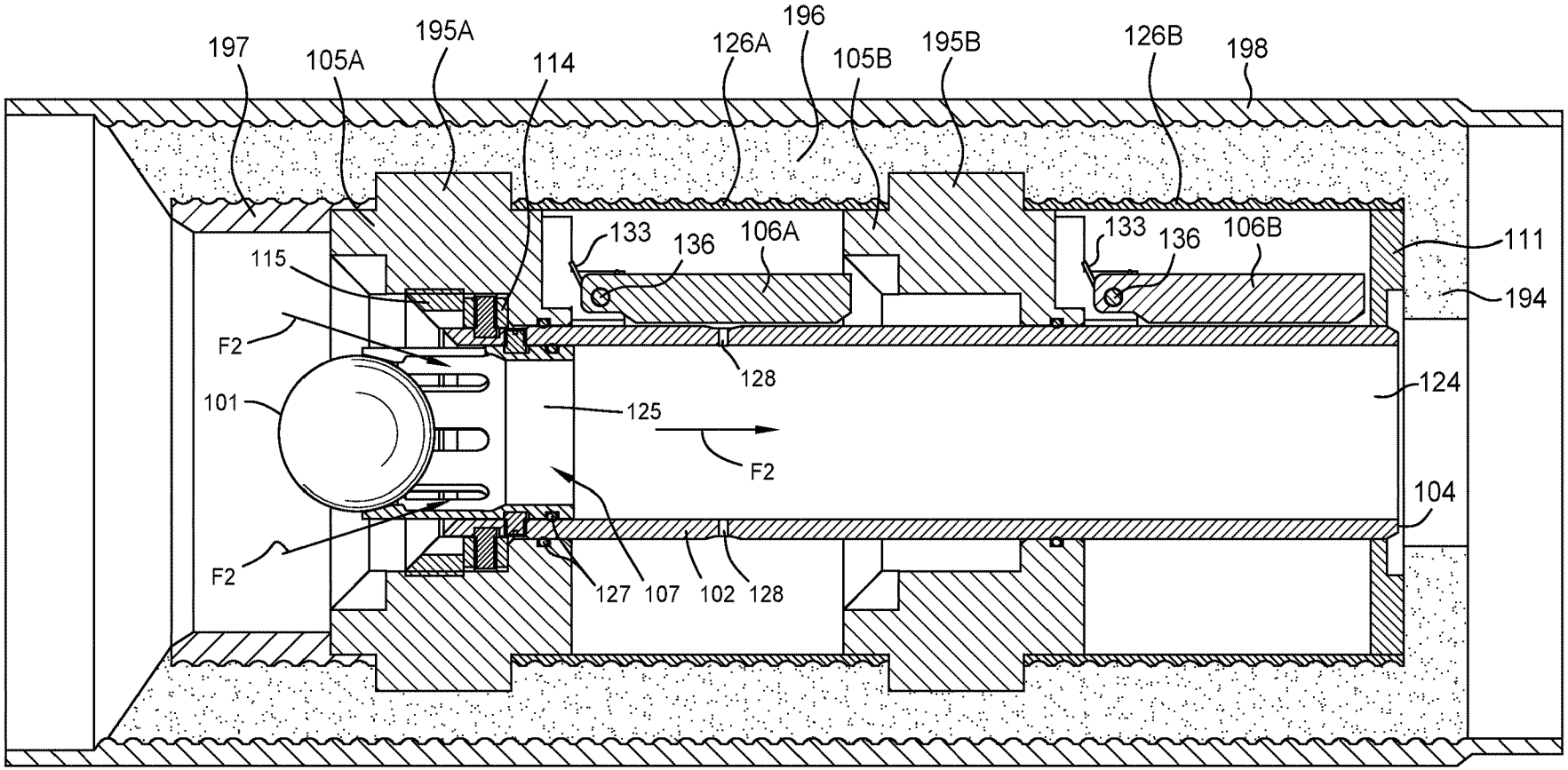
FIG. 2A is a schematic cross-sectional view of the convertible float valve assembly and the ball, according to one implementation.
Figure 2B:
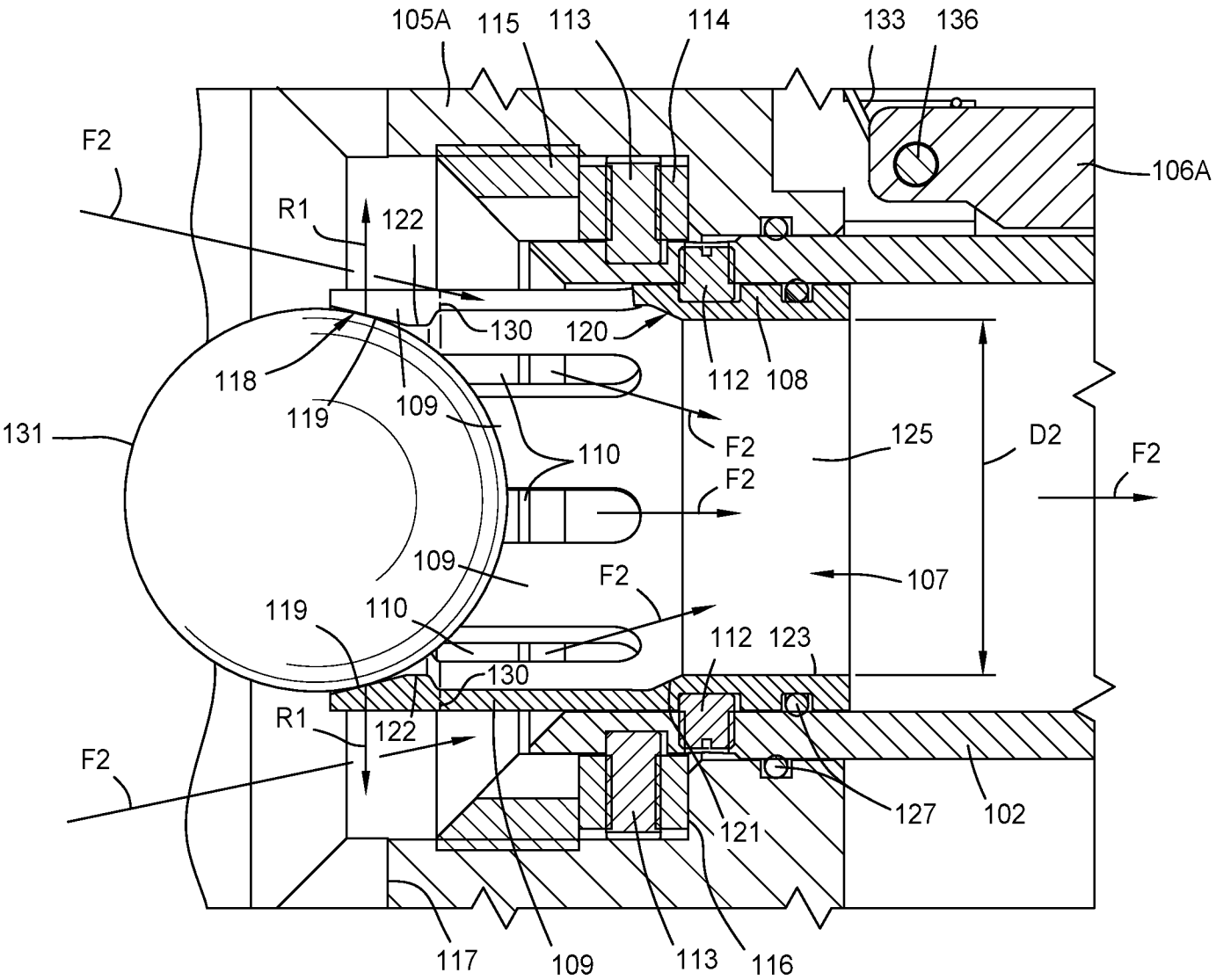
FIG. 2B is an enlarged view of a portion of the convertible float valve assembly shown in FIG. 2A, according to one implementation.

FIG. 2A is a schematic cross-sectional view of the convertible float valve assembly 100 and the ball 101, according to one implementation. FIG. 2B is an enlarged view of a portion of the convertible float valve assembly 100 shown in FIG. 2A, according to one implementation. The convertible float valve assembly 100 is shown in FIGS. 2A and 2B as having been lowered downhole to a desired location within a wellbore. A fluid F2 is pumped downhole. In one embodiment, which can be combined with other embodiments, the fluid F2 is an operation fluid (such as drilling fluid or casing cement) that is pumped downhole. The fluid F2 is pumped downhole at an operating pressure.

The ball 101 is moved into contact with the collet 107 and is seated on the collet seat 118. An outer surface 131 of the ball 101 is in contact with the angled inner surfaces 119. The seating of the ball 101 on the collet seat 118 includes the ball 101 contacting the angled inner surfaces 119. When the ball 101 seats on the collet seat 118, the central opening 125 is at least partially blocked using the ball 101 such that the fluid F2 is directed through the slots 110, into the collet 107, and through the central opening 125 after flowing through the slots 110. When the ball 101 seats onto the collet seat 118, a first pressure indication is induced as a result of the ball 101 at least partially blocking the central opening 125. The first pressure indication indicates a first pressure that is greater than the operating pressure at which the fluid F2 is pumped downhole. The first pressure indicated by the first pressure indication is greater than the operating pressure.

Figure 3A:
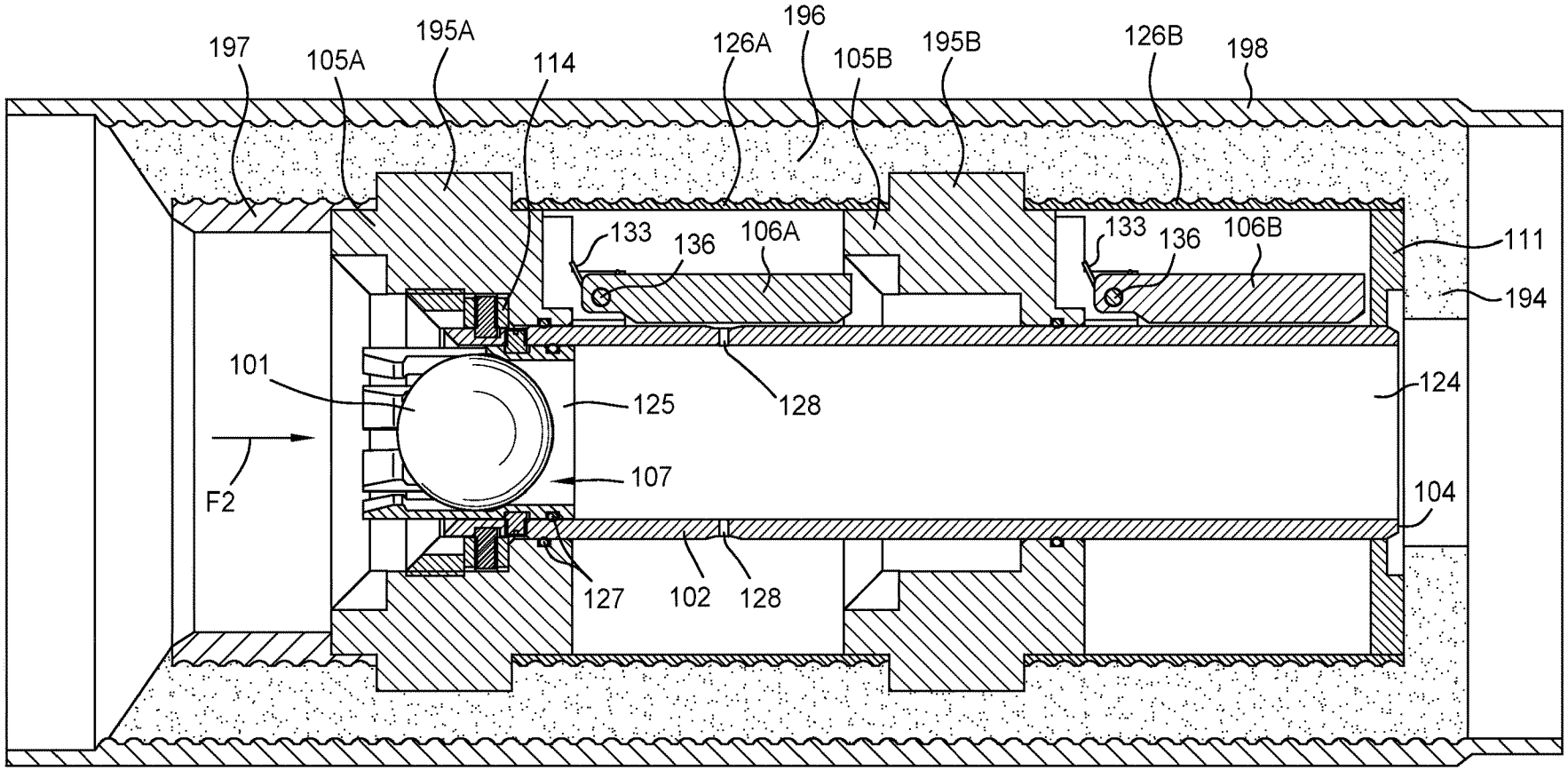
FIG. 3A is a schematic cross-sectional view of the convertible float valve assembly and the ball, according to one implementation.
Figure 3B:
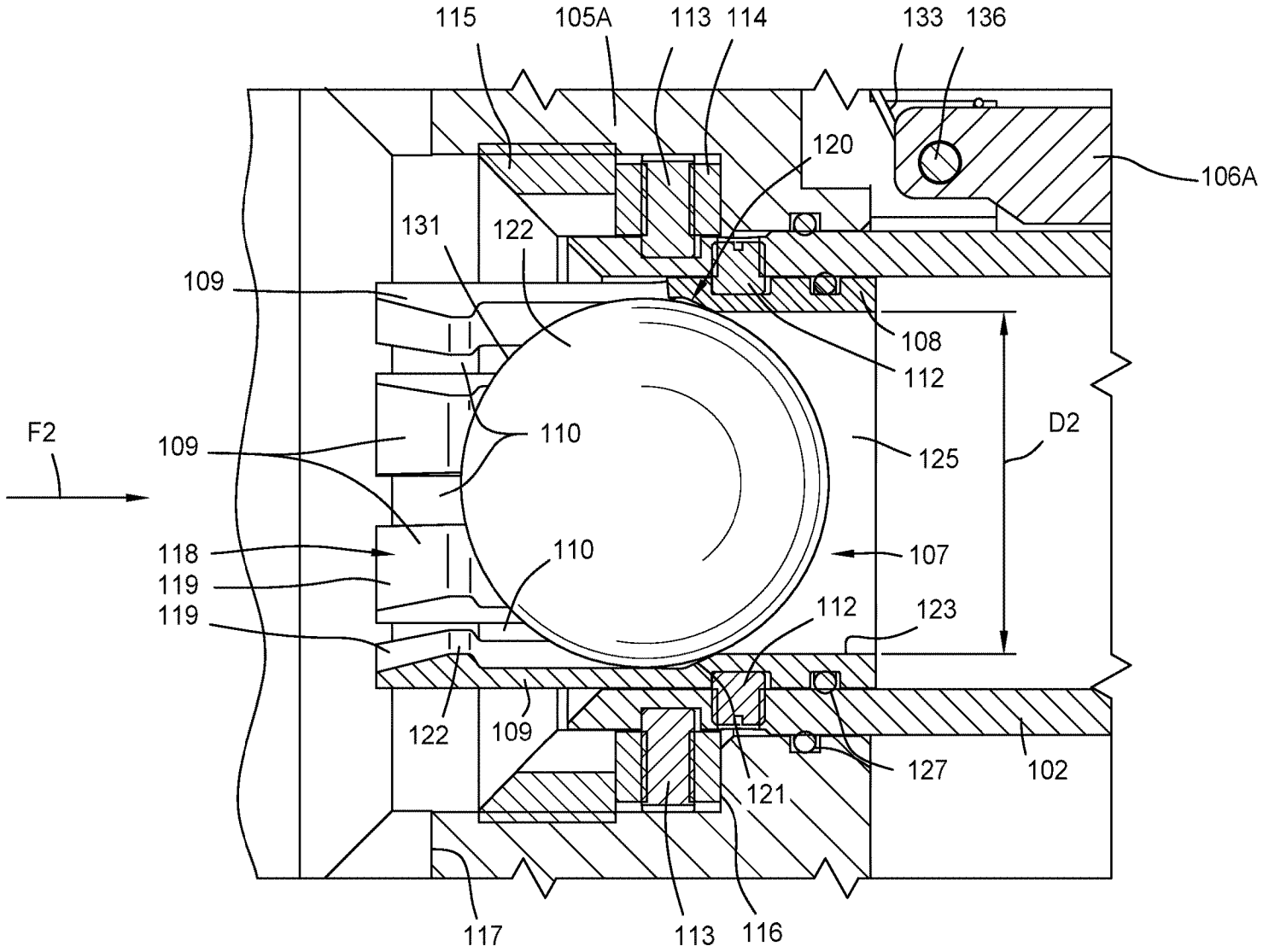
FIG. 3B is an enlarged view of a portion of the convertible float valve assembly shown in FIG. 3A, according to one implementation.

In one embodiment, which can be combined with other embodiments, the fluid F2 moves the ball 101 past the collet seat 118 to seat the ball 101 on the sealing seat 120 (as discussed in relation FIGS. 3A and 3B). In one example, the at least partial blocking of the central opening 125 by the ball 101 causes a pressure build of the fluid F2 that moves the ball 101 past the collet seat 118. In one example, the fluid F2 is pumped at a higher operating pressure to move the ball 101 past the collet seat 118. In such an embodiment, the moving the ball 101 past the collet seat 118 pushes the plurality of collet fingers 109 radially outward in radial directions R1 as shown in FIG. 2B. The ball 101 moves past the collet seat 118 and pushes the collet fingers 109 radially outward by moving the ball 101 along the angled inner surfaces 119.

In one embodiment, which can be combined with other embodiments, the operating pressure of the fluid F2 does not move the ball 101 past the collet seat 118. The collet 107 (including at least the ring body 108 and the collet fingers 109) is formed of a dissolvable material. In one embodiment, which can be combined with other embodiments, the dissolvable material of the collet 107 includes a magnesium alloy. In one embodiment, which can be combined with other embodiments, the dissolvable material of the collet 107 includes a lightweight aluminum alloy. In one embodiment, which can be combined with other embodiments, the dissolvable material of the collet 107 includes one or more of Al 3104 (such as Al 3104-H19) and/or Al 3004 (such as Al 3004-H19). The dissolvable materials dissolves upon interaction with an abrasive material, a chemical dissolution material, and/or an erosion material. A material (such as the fluid F2) is pumped downhole and includes one or more of the abrasive material, the chemical dissolution material, and/or the erosion material. The material pumped downhole at least partially dissolves the collet fingers 109 and/or the ring body 108 of the collet 107 to move the ball 101 toward the sealing seat 120 to seat on the sealing seat 120 (as shown in FIGS. 3A and 3B). In one example, the collet 107 is dissolved to approximately dashed lines 130 to move the ball 101 and seat the ball 101 on the sealing seat 120. In such an embodiment, the ball 101 is moved to seat on the sealing seat 120 by dissolving the collet seat 118 and the first inner faces 122. In one example, the material is pumped to dissolve the collet 107 if pressure of fluid F2 does not move the ball 101 past the collet seat 118. The dissolvable material of the collet 107 provides a secondary activation mechanism for the convertible float valve assembly 100. In one embodiment, which can be combined with other embodiments, the chemical dissolution material includes an acid.

The moving the ball 101 to seat the ball 101 on the sealing seat 120 induces a second pressure indication that indicates a second pressure resulting from the temporary movement of the ball 101. The second pressure indicated by the second pressure indication is lesser than the first pressure.

FIG. 3A is a schematic cross-sectional view of the convertible float valve assembly 100 and the ball 101, according to one implementation. FIG. 3B is an enlarged view of a portion of the convertible float valve assembly 100 shown in FIG. 3A, according to one implementation. In FIGS. 3A and 3B, the ball 101 is seated on the sealing seat 120 in a ball-on-seat configuration. The outer surface 131 of the ball 101 is in contact with the one or more angled inner surfaces 121.

Figure 4A:
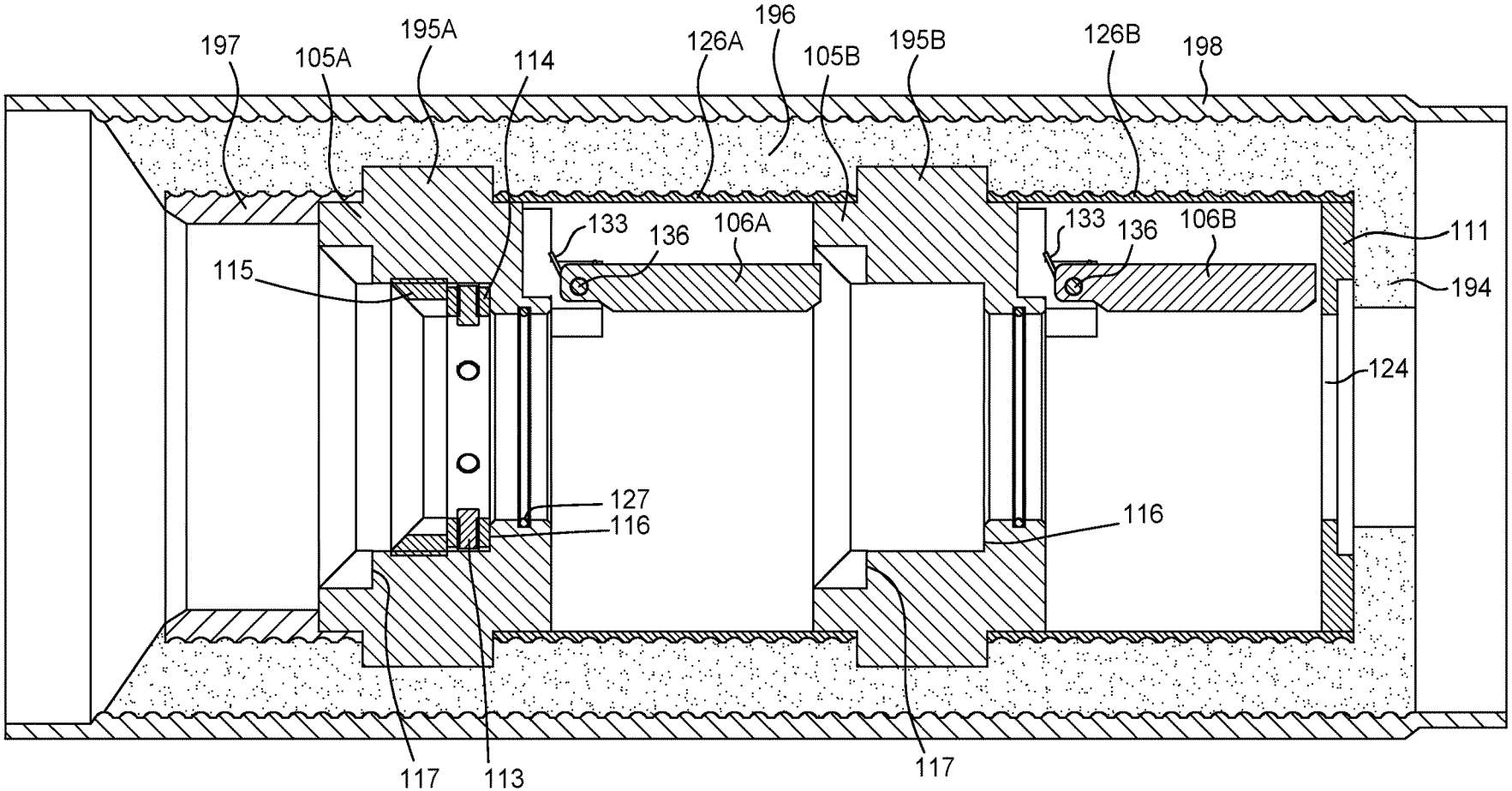
FIG. 4A is a schematic cross-sectional view of the convertible float valve assembly shown in FIG. 3A after the sleeve is released, according to one implementation.
Figure 4B:
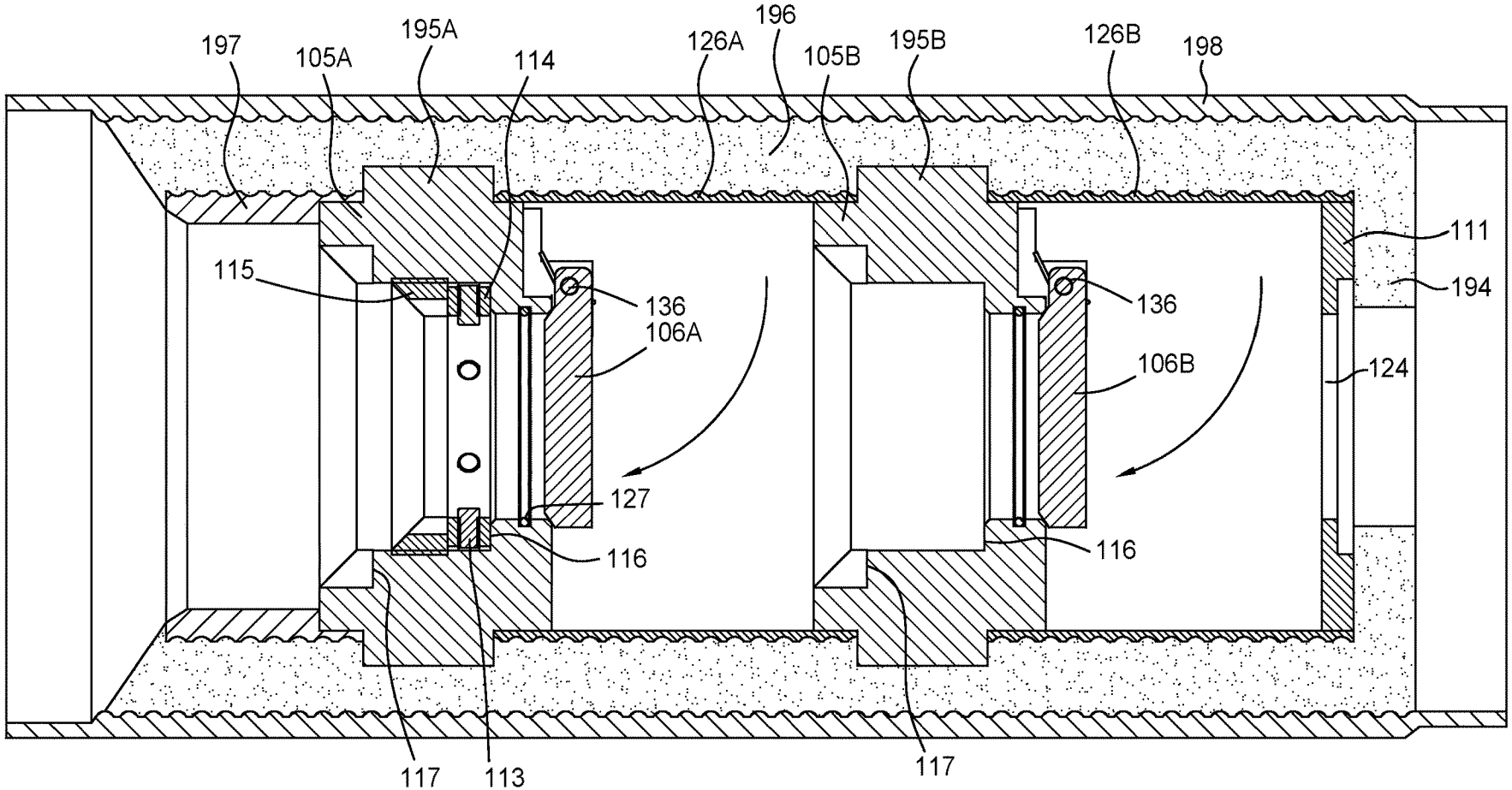
FIG. 4B is a schematic cross-sectional view of the convertible float valve assembly shown in FIG. 4A in the closed position, according to one implementation.

Upon seating of the ball 101 on the sealing seat 120, a third pressure indication is induced that indicates a third pressure as a result of the ball 101 blocking the central opening 125 of the collet 107. The third pressure indicated by the third pressure indication is greater than the second pressure. The third pressure is also greater than the first pressure. The ball 101 seating on the sealing seat 120 entirely blocks the central opening 125 such that the fluid F2 does not flow past the ball 101 and into the central opening 125. The ball 101 entirely blocks the central opening 125 such that pressure builds on one side of the ball 101. The pressure increases until the shearable fasteners 113 shear to release the sleeve 102 (and the collet 107 coupled to the sleeve 102) from the one or more valve bodies 105A, 105B (such as from the first valve body 105A. The shearing of the shearable fasteners 113 and release of the sleeve 102 induces a fourth pressure indication that indicates a fourth pressure. The fourth pressure is less than the third pressure. After shearing, the sleeve 102, the collet 107, and the ball 101 move downhole to be outside of the valves 106A, 106B (as shown in FIGS. 4A and 4B). The fasteners 112 have a shear strength that is greater than a shear strength of the shearable fastener 113 such that the shearable fasteners 113 shear apart prior to the fasteners 112.

FIG. 4A is a schematic cross-sectional view of the convertible float valve assembly 100 shown in FIG. 3A after the sleeve 102 is released, according to one implementation. In FIG. 4A, the sleeve 102, the ball 101, and the collet 107 have been released from the one or more valve bodies 105A, 105B and have moved downhole. Portions of the shearable fasteners 113 are shown as the shearable fasteners 113 have been sheared apart. After the sleeve 102, the ball 101, and the collet 107 have been released and moved downhole, the sleeve 102 is no longer blocking the valves 106A, 106B to hold the valves 106A, 106B in the open position. FIG. 4A shows the valves 106A, 106B in the open position. However, after the sleeve 102 is released and the valves 106A, 106B are no longer blocked, the valves 106A, 106B are biased into a closed position using biasing members, such as springs 133 that bias the valves 106A, 106B closed. In one embodiment, which can be combined with other embodiments, the springs 133 are hinge springs, such as 90 degree hinge springs.

FIG. 4B is a schematic cross-sectional view of the convertible float valve assembly 100 shown in FIG. 4A in the closed position, according to one implementation. In FIG. 4B, the valves 106A, 106B have been biased into the closed position. The valves 106A, 106B are biased by the springs 133 until the valves abut against, respectively, a backside surface 134A of the first valve body 105A and a backside surface 134B of the second valve body 105B, which function as seats that the valves 106A, 106B can seal against.

FIG. 4B is shown in a back-pressure mode, after the convertible float valve assembly 100 has been activated to convert the convertible float valve assembly 100 from the autofill mode (shown in FIG. 1A) and to the back-pressure mode. In the back-pressure mode, as shown, the valves 106A, 106B are one-way check valves. In the back-pressure mode, fluid such as an operating fluid (for example drilling fluid or casing cement) flows through the valves 106A, 106B when flowing in a downhole direction D1 as the fluid flow at least partially opens the valves 106A, 106B. In the back-pressure mode, fluid such as an operating fluid (for example drilling fluid or casing cement) does not flow back up through the valves 106A, 106B when flowing in an uphole direction D2 as the valves 106A, 106B remain abutted against the backside surfaces 134A, 134B and in the closed position against the fluid flow. An operating fluid, such as drilling fluid or casing cement, is pumped downhole in the downhole direction D1 and flows past the valves 106A, 106B, and the operating fluid cannot flow back in the uphole direction D2.

Figure 5A:
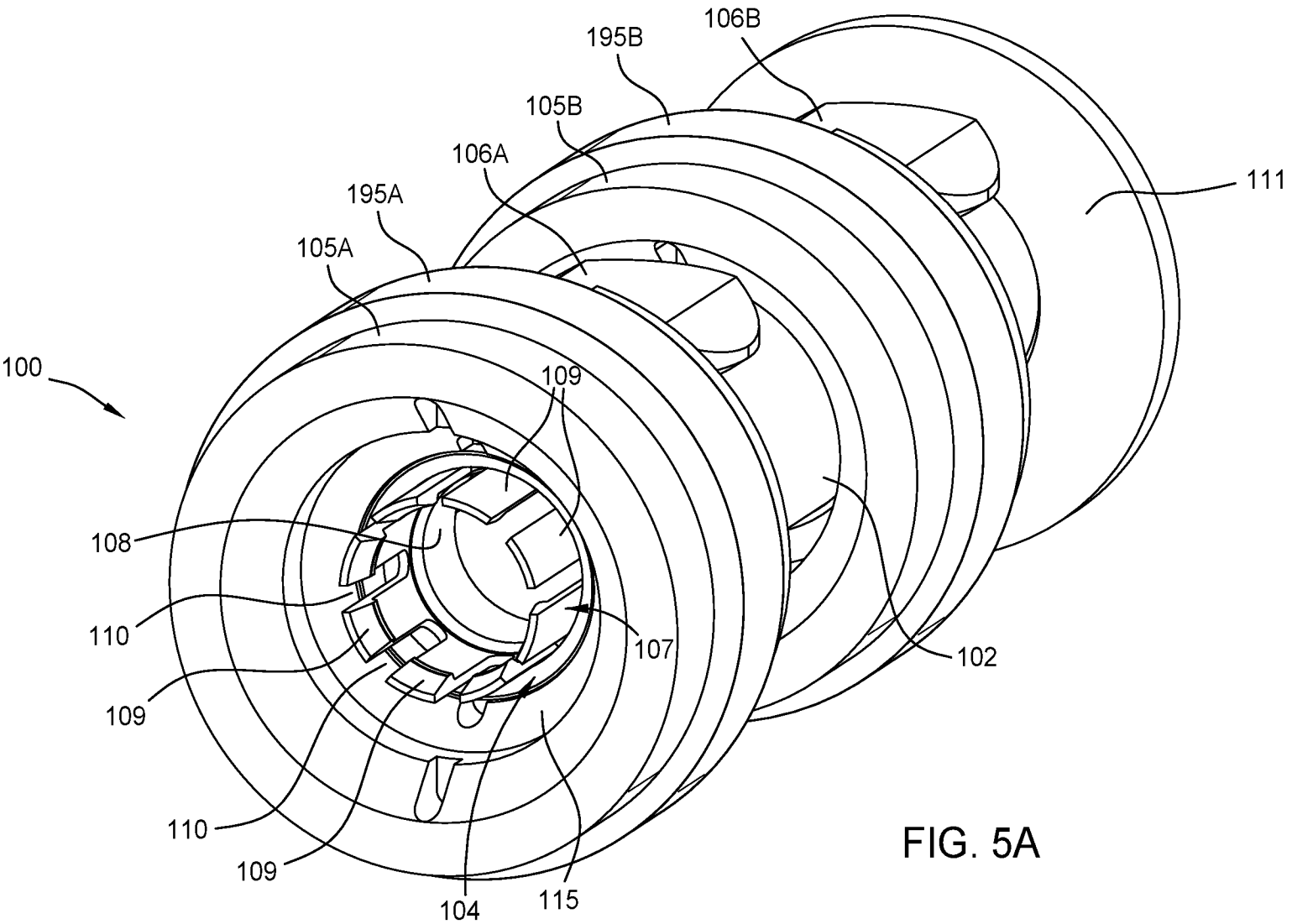
FIG. 5A is a schematic front isometric view of the convertible float valve assembly shown in FIG. 1A, according to one implementation.

FIG. 5A is a schematic front isometric view of the convertible float valve assembly 100 shown in FIG. 1A, according to one implementation. The tubular sections 126A, 126B, the cement 196, the retention sleeve 197, and the float collar 198 are not shown in FIG. 5A for ease of reference.

Figure 5B:
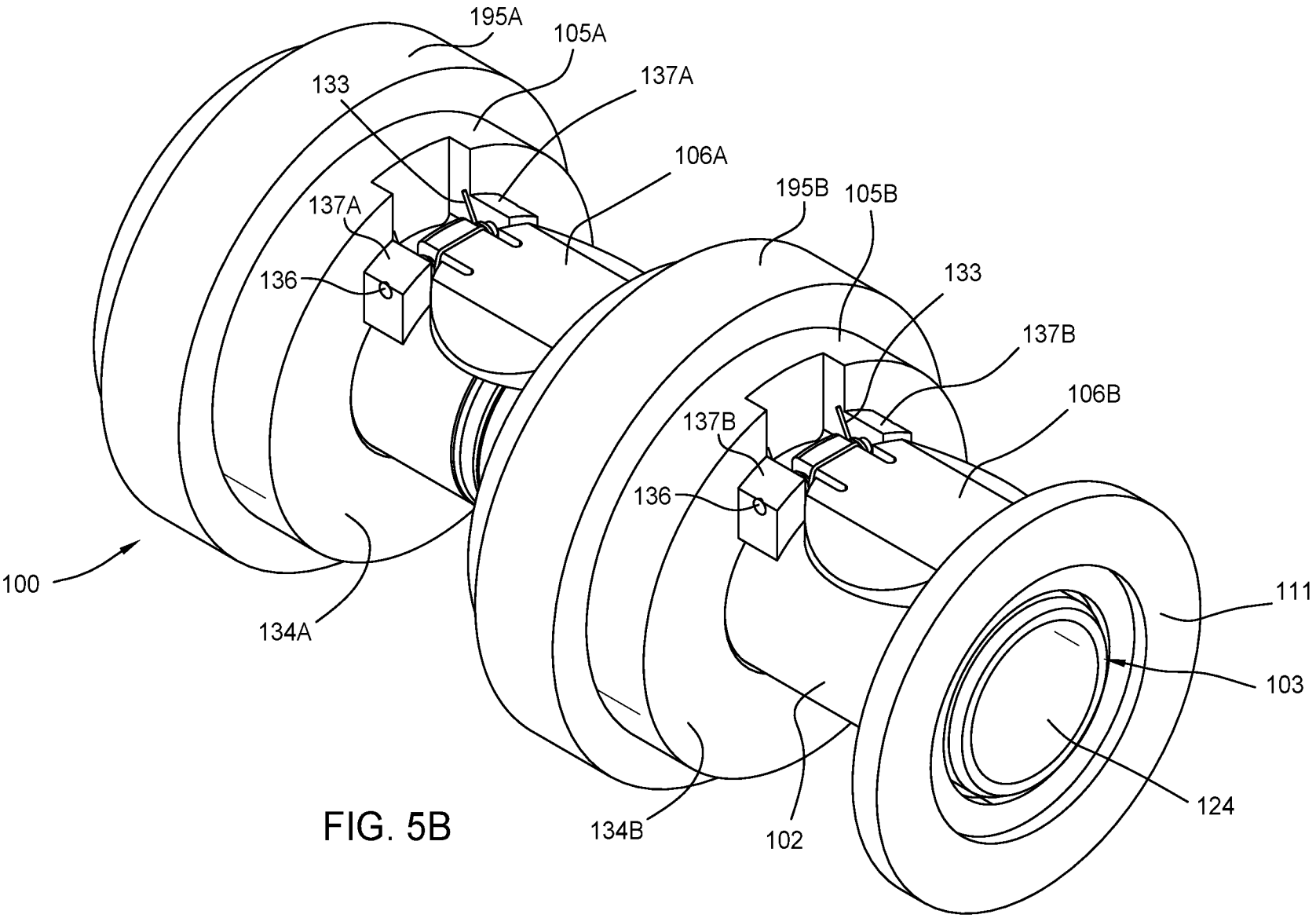
FIG. 5B is a schematic back isometric view of the convertible float valve assembly shown in FIG. 5A, according to one implementation.

FIG. 5B is a schematic back isometric view of the convertible float valve assembly 100 shown in FIG. 5A, according to one implementation. The tubular sections 126A, 126B, the cement 196, the retention sleeve 197, and the float collar 198 are not shown in FIG. 5B for ease of reference. The springs 133 are disposed, respectively, about pins 136 that are disposed through the valves 106A, 106B and through protrusions 137A, 137B that protrude from the backside surfaces 134A, 134B of the valves 106A, 106B.

The present disclosure discloses methods of operating the convertible float valve assembly 100. The method includes lowering the convertible float valve assembly 100 and the ball 101 downhole with the one or more valves 106A, 106B in the open position. The method also includes pumping the fluid F2 downhole at the operating pressure, and seating the ball 101 on the collet seat 118 of the collet 107 to induce the first pressure indication that indicates the first pressure greater than the operating pressure. The method also includes releasing the sleeve 102 of the convertible float valve assembly 100 from the one or more valve bodies 105A, 105B of the convertible float valve assembly 100. The ball 101 is free-floating when lowering the pump converted apparatus 100 downhole.

The method also includes, prior to releasing the sleeve 102, moving the ball 101 past the collet seat 118 to induce the second pressure indication that indicates the second pressure lesser than the first pressure, and seating the ball 101 on the sealing seat 120 of the collet 107 to induce the third pressure indication that indicates the third pressure greater than the second pressure. The method also includes, prior to seating the ball 101 on the sealing seat 120, flowing the fluid F2 through the plurality of slots 110 of the collet 107.

In one embodiment, which can be combined with other embodiments, the moving the ball 101 past the collet seat 118 includes moving the ball 101 along the plurality of angled inner surfaces 119 of the plurality of collet fingers 109 of the collet 107, and pushing the plurality of collet fingers 109 radially outward.

In one embodiment, which can be combined with other embodiments, the moving the ball 101 past the collet seat 118 includes dissolving at least a portion of each of the plurality of collet fingers 109 of the collet 107. In such an embodiment, the plurality of collet fingers 109 are formed of a lightweight aluminum alloy. The dissolving the plurality of collet fingers 109 includes pumping an abrasive material to the collet 107.

The releasing the sleeve 102 includes shearing the one or more shearable fasteners 113 disposed between the sleeve 102 and the fastener housing 114 retained within the valve body 105A of the one or more valve bodies 105A, 105B. The method also includes, after releasing the sleeve 102 from the one or more valve bodies 105A, 105B, biasing the one or more valves 106A, 106B into the closed position. Lowering the convertible float valve assembly 100 and the ball 101 downhole includes flowing the fluid F1 through the central opening 124 of the sleeve 102, through the central opening 125 of the collet 107, and past the ball 101.

As discussed herein, the present disclosure contemplates that the shearing of the one or more shearable fasteners 113 may include dissolving a dissolvable material of the shearable fasteners 113 using the fluid F2. Dissolving the shearable fasteners 113 can facilitate a reduction in operating pressure of the fluid F2 by facilitating a reduction in shear load to shear the shearable fasteners 113. Dissolving the shearable fasteners 113 can also facilitate interventionless auto-conversion of the convertible float valve assembly 100. In one embodiment, which can be combined with other embodiments, the dissolving the dissolvable material of the shearable fasteners 113 shears the shearable fasteners 113 and releases the sleeve 102 while the ball 101 is seated on the collet seat 118. In one embodiment, which can be combined with other embodiments, the dissolving the dissolvable material of the shearable fasteners 113 shears the shearable fasteners 113 and releases the sleeve 102 at a collet choke pressure or a collet ball-on-seat pressure.

Benefits of the present disclosure include reliable activation of convertible float valve assemblies; reduced interference of clogging with convertible float valve assemblies; convertible float valve activation at reduced operation timespans; quick activation of flow modes for convertible float valve assemblies; activation at reduced fluid circulations; activating convertible float valve assemblies without dropping a ball from surface; secondary activation mechanisms for convertible float valve assemblies; modularity of use of convertible float valve assemblies with fluids, flow rates, and other downhole devices; reduced interference, such as from impact and shock, of rapid pipe movement while lowering convertible float valve assemblies downhole. For example, aspects described herein facilitate reduced or eliminated probability of accidental activation of convertible float valve assemblies due to tube movement and/or tubing shock loads (for example, during stop/start operations) during running/tripping in hole.

Aspects of the present disclosure include lowering a ball downhole in a free-floating configuration with a convertible float valve assembly; a collet of the convertible float valve assembly having collet fingers and slots; a collet of the convertible float valve assembly having a collet seat and a sealing seat; a collet of the convertible float valve assembly formed of a dissolvable material; a collet of the convertible float valve assembly coupled to a sleeve, and the sleeve coupled to a valve body through shearable fasteners; and methods of using the same.

It is contemplated that one or more of the aspects disclosed herein may be combined. Moreover, it is contemplated that one or more of these aspects may include some or all of the aforementioned benefits.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A convertible float valve assembly, comprising:

a sleeve comprising a first end and a second end;

one or more valve bodies disposed about the sleeve;

one or more valves disposed about the sleeve and coupled to the one or more valve bodies, wherein the sleeve extends through the valve bodies and the valves to temporarily hold the valves in an open position; and a collet coupled to the sleeve and disposed at least partially within the sleeve, wherein the collet is located uphole relative to the valve bodies and the valves, the collet comprising:

a ring body, a plurality of collet fingers extending from the ring body, and a plurality of slots formed between the plurality of collet fingers;

wherein the collet further comprises a collet seat defined at least partially by a plurality of angled inner surfaces of the plurality of collet fingers and wherein the collet further comprises a sealing seat formed inwardly of the collet seat and the plurality of slots.

2. The convertible float valve assembly of claim 1, wherein the collet seat comprises a first seat diameter, and the sealing seat comprises a second seat diameter that is lesser than the first seat diameter.

3. The convertible float valve assembly of claim 2, further comprising a ball, wherein when the ball is seated on the collect seat, fluid can flow past the ball through the slots, and wherein when the ball is seated on the sealing seat, fluid cannot flow past the ball through the slots.

4. The convertible float valve assembly of claim 1, further comprising one or more shearable fasteners coupled to the sleeve.

5. The convertible float valve assembly of claim 4, wherein the one or more shearable fasteners are housed in a fastener housing.

6. The convertible float valve assembly of claim 5, further comprising a retainer ring coupled to a valve body of the one or more valve bodies to retain the fastener housing between the retainer ring and an inner shoulder of the valve body.

7. A convertible float valve assembly, comprising:

a sleeve comprising a first end and a second end; one or more valve bodies disposed about the sleeve;

one or more valves disposed about the sleeve and coupled to the one or more valve bodies, wherein the sleeve extends through the valve bodies and the valves to temporarily hold the valves in an open position; and a collet coupled to the sleeve and disposed at least partially within the sleeve, wherein the collet is located uphole relative to the valve bodies and the valves, and wherein the collet is formed of a dissolvable material;

wherein the collet further comprises a collet seat defined at least partially by a plurality of angled inner surfaces of a plurality of collet fingers and wherein the collet further comprises a sealing seat formed inwardly of the collet seat and the plurality of slots.

8. The convertible float valve assembly of claim 7, wherein the dissolvable material comprises a lightweight aluminum alloy or a magnesium alloy.

9. The convertible float valve assembly of claim 7, further comprising a ball, wherein when the ball is seated on the collet, fluid can flow past the ball through a plurality of slots formed in the collet.

10. A method of operating a convertible float valve assembly, comprising:

lowering the convertible float valve assembly and a ball downhole, the convertible float valve assembly comprising a collet and one or more valves in an open position;

pumping a fluid downhole at an operating pressure;

seating the ball on a collet seat of the collet to induce a first pressure indication that indicates a first pressure greater than the operating pressure; and releasing a sleeve of the convertible float valve assembly from one or more valve bodies of the convertible float valve assembly;

wherein, prior to releasing the sleeve:

moving the ball past the collet seat to induce a second pressure indication that indicates a second pressure lesser than the first pressure; and seating the ball on a sealing seat of the collet to induce a third pressure indication that indicates a third pressure greater than the second pressure.

11. The method of claim 10, wherein the ball is free-floating when being lowered downhole.

12. The method of claim 10, further comprising, prior to seating the ball on the sealing seat, flowing the fluid through a plurality of slots of the collet.

13. The method of claim 10, wherein the moving the ball past the collet seat comprises moving the ball along a plurality of angled inner surfaces of a plurality of collet fingers of the collet and pushing the plurality of collet fingers radially outward.

14. The method of claim 10, wherein the moving the ball past the collet seat comprises dissolving at least partially a plurality of collet fingers of the collet.

15. The method of claim 14, wherein the plurality of collet fingers are formed of a lightweight aluminum alloy.

16. The method of claim 14, wherein the dissolving at least partially the plurality of collet fingers comprises pumping an abrasive material to the collet.

17. The method of claim 10, wherein the releasing the sleeve comprises shearing one or more shearable fasteners disposed between the sleeve and a fastener housing retained within a valve body of the one or more valve bodies.

18. The method of claim 17, further comprising, after releasing the sleeve from the one or more valve bodies, biasing the one or more valves into a closed position.

19. The method of claim 10, wherein the lowering the convertible float valve assembly and the ball downhole comprises flowing the fluid through a central opening of the sleeve, through a central opening of the collet, and past the ball.

* * * * *